US005649344A

United States Patent [19]

Roelstraete

[11] Patent Number: 5,649,344

[45] Date of Patent: Jul. 22, 1997

[54] PROCESS AND DEVICE FOR DRAWING IN NEW WARP THREADS

[75] Inventor: Kristof Roelstraete, Zwevegem, Belgium

[73] Assignee: Picanol, N.V., Ieper, Belgium

[21] Appl. No.: 532,561

[22] PCT Filed: Apr. 13, 1994

[86] PCT No.: PCT/EP94/01132

§ 371 Date: Dec. 14, 1995

§ 102(e) Date: Dec. 14, 1995

[87] PCT Pub. No.: WO94/24351

PCT Pub. Date: Oct. 27, 1994

[30] Foreign Application Priority Data

Apr. 15, 1993 [BE] Belgium ..... 9300370

[51] Int. Cl.[6] ..... D03J 1/14

[52] U.S. Cl. ..... 28/203.1

[58] Field of Search ..... 28/204, 203.1, 28/206, 207

[56] References Cited

U.S. PATENT DOCUMENTS

| | | | |
|---|---|---|---|
| 3,072,999 | 1/1963 | Cook et al. | 28/204 |
| 3,348,282 | 10/1967 | Baumgarten et al. | 28/204 |

FOREIGN PATENT DOCUMENTS

| | | | |
|---|---|---|---|
| 426683 | 12/1966 | Switzerland . | |
| 426683 | 6/1967 | Switzerland . | |
| 59514 | 1/1922 | U.S.S.R. | 28/204 |

*Primary Examiner*—John J. Calvert
*Attorney, Agent, or Firm*—Bacon & Thomas

[57] ABSTRACT

A method for advancing and drawing in new warp threads connected by knots to existing warp threads in a weaving machine wherein the warp threads are advanced through apertured elements such as heddles of shed-forming devices or a warp stop motion wherein the warp threads are advanced to the apertures at an angle of less than 90°. Apparatus for achieving the method includes supporting arrangements for heddles and warp stop motion elements, including an arrangement to vary the angle of approach to warp stop motion elements by the warp threads.

26 Claims, 6 Drawing Sheets

PROCESS AND DEVICE FOR DRAWING IN NEW WARP THREADS

BACKGROUND OF THE INVENTION

A. Field of the Invention

The invention concerns a method for drawing new warp threads from a warp beam into and through a warp stop motion and/or a shed-forming device of a weaving machine or loom, wherein the beginnings of the new warp threads are connected by thread connections with the ends of the warp threads already in the warp stop motion and/or shed-forming device and then are pulled through apertures of elements of the warp stop motion and/or shed-forming device, and further concerns apparatus with which to carry out said method.

B. Related Art

It is known to sever old warp-beam warp threads located in the warp stop motion, the shed-forming device and the reed and to link them to the beginnings of the warp threads of a new warp beam. This linking may be in the form of knotting or splicing. Following such linking, the new warp threads are drawn-in by the old warp threads, the thread linkages by the threads themselves are pulled through the apertures of the warp stop motion drop wires and through apertures of heddles of the harnesses and through the reed. This drawing-in or advancement of the linked warp threads is delicate. If a knot or the like catches on one of the mentioned apertures, warp threads may rupture. It is known that it is easier to draw-in the thread-linked warp threads if they are beaten or if they are made to vibrate in some other way.

The object of the invention is to facilitate the drawing-in procedure and to reduce the danger of thread rupture thereby.

BRIEF SUMMARY OF THE INVENTION

This problem is solved by configuring the elements of warp stop motion and/or shed-forming device and/or by guiding the warp threads, so that the warp threads including the thread-linkages enter the apertures through which they are being pulled at an angle less than 90°.

Experiment has shown that by drawing and pulling the warp threads into and through the apertures during an oblique manner, the danger of warp thread rupture is reduced in such introduction, and that at the same time the rate of drawing-in can be raised.

In a further variation of the invention means are provided, in an apparatus for implementing the method of the invention, to mount the elements of a warp stop motion and/or a shed-forming device obliquely to the direction of warp advance. In another embodiment, guides are provided in front of or after the elements of a warp stop motion and/or a shed-forming device to align the direction of warp advance relative to the elements.

Further features and advantages of the invention are stated and elucidated in the following description of the illustrative embodiment shown in the drawings.

DETAILED DESCRIPTION OF PREFERRED EMBODIMENT(S)

Figure 1:
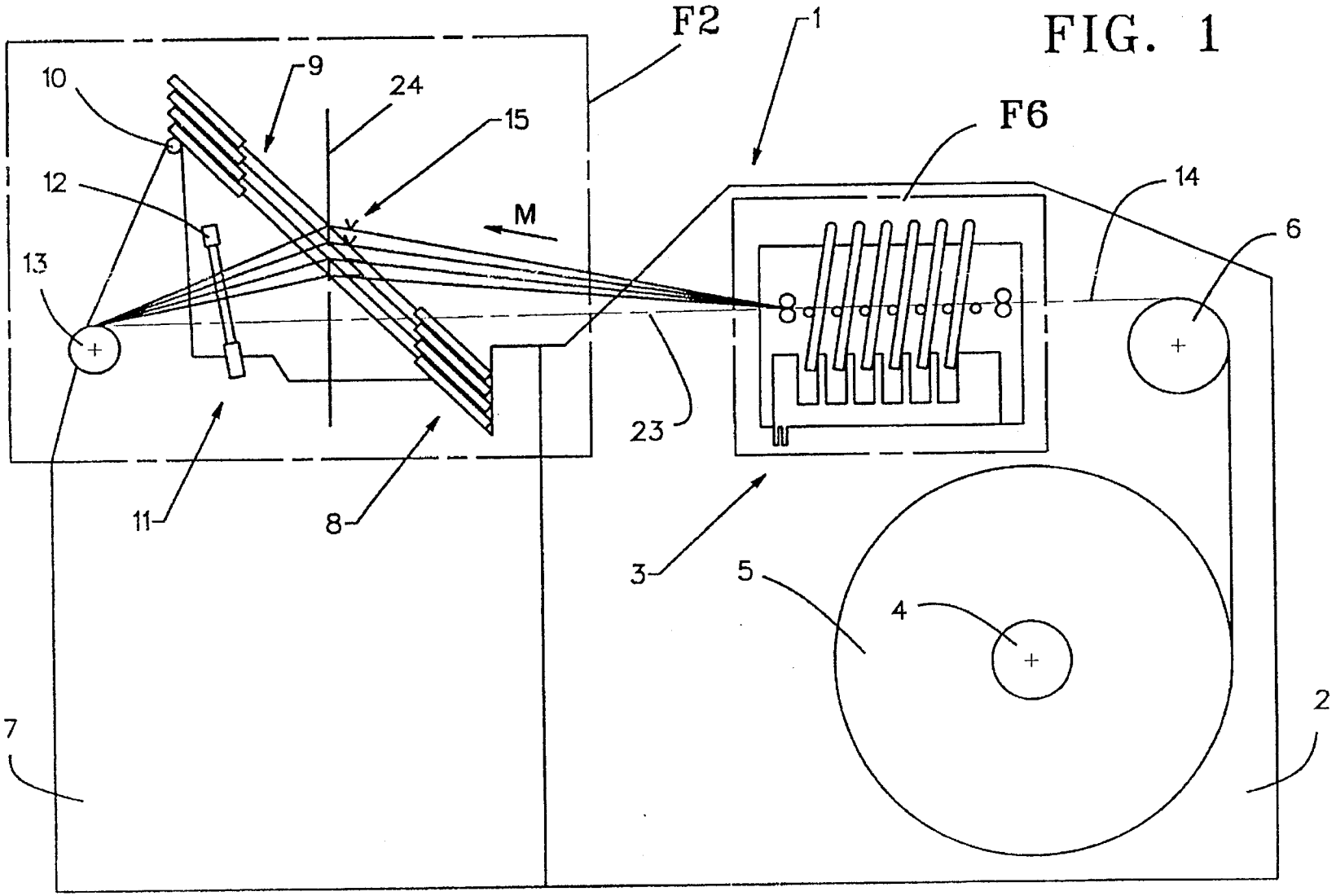
FIG. 1 schematically shows apparatus with which to carry out the method of the invention.

The apparatus 1 shown in FIG. 1 comprises a weaving machine or loom portion 2 with a warp stop motion 3, a warp beam 5 resting on a shaft 4 and a whip roll 6. This loom portion 2 is mounted to a frame 7 comprising a housing 8 for the harnesses 9 of a pack of harnesses 9 and a housing 11 for a reed 12. Moreover this frame 7 comprises a warp draw-in device 13. The housing 8 is fitted with a lower receiving means for the harnesses 9 and an upper rest 10, as a result of which the harnesses 9 are spaced along the warp thread advance direction, slant at an angle of about 45° and are mutually offset heightwise (the direction extending away from the imaginary line or plane 23 to be more fully described below).

Warp threads 14 from the new and full warp beam 5 run over the whip roll 6 through the warp stop motion 3 and through the harnesses 9 and reed 12 toward the drawing-in device 13.

Figure 3:
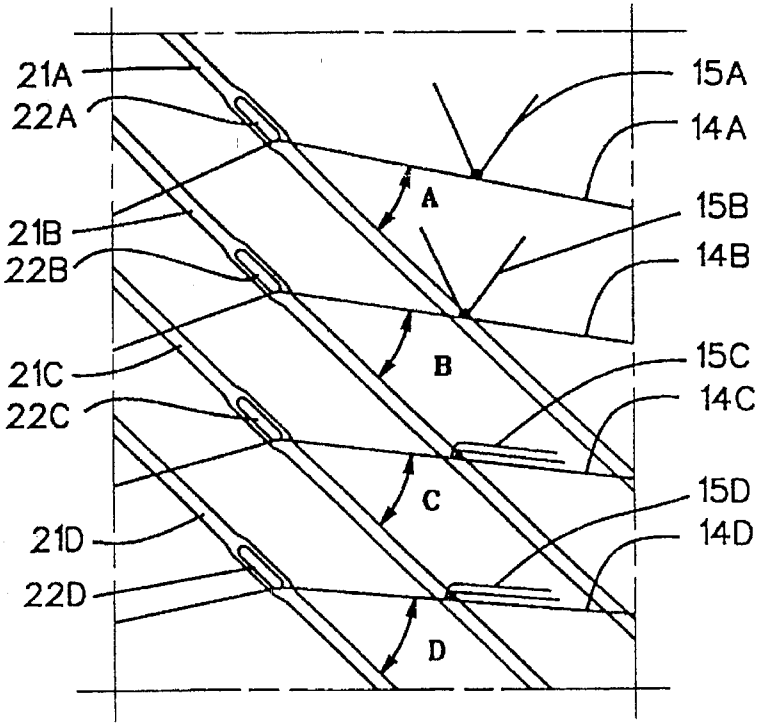
FIG. 3 is an enlarged cutaway denoted by F3 in FIG. 2.

The harnesses 9 comprise a plurality of apertured elements in the form of heddles 21 each fitted with an aperture 22 in the form of a thread-eyelet 22. As shown by FIG. 3, these apertures 22 are each configured to have an elongated cross-section running in the lengthwise direction of the heddles 21 and are constituted by two narrow sides and two longitudinal sides. Each aperture 22 is an oval in cross-section and lies in an imaginary principal plane that includes the respective aperture, such plane typically extending parallel with the lengthwise direction of heddle 21. The smaller oval diameter is at least three times the standard thickness of the warp threads 14, the larger diameter being a multiple of the smaller one.

The harnesses 9 are held in such manner in the housing 8 and by the rest 10 that they slant away by about 45° to the vertical from the warp stop motion 3. The harnesses 9 moreover are mounted in such manner that they deflect the warp threads 14 from an imaginary straight connecting line or common plane 23 extending between and intersecting the outlet of the warp stop motion 3 and the contact region along which the warp threads engage the draw-in apparatus or device 13. Accordingly the warp threads 14 always rest on or engage the lower, narrow side of the apertures 22, and they are deflected from that point on. Consequently the warp threads 14 approach and enter the apertures 22 at an acute angle (i.e., less than 90° on the approach side of the apertures facing the advancing warp threads), the angles A, B, C, D being the more acute the farther the apertures 22 are from the imaginary connecting line or plane 23. The entry angle A relative to the aperture 22 of the heddle 21 of the harness facing warp stop motion 3 is therefore the smallest, whereas the entry angle D of the warp 14 relative to the aperture 22 of the heddle 21 of the harness facing the reed 12 is the largest.

Figure 2:
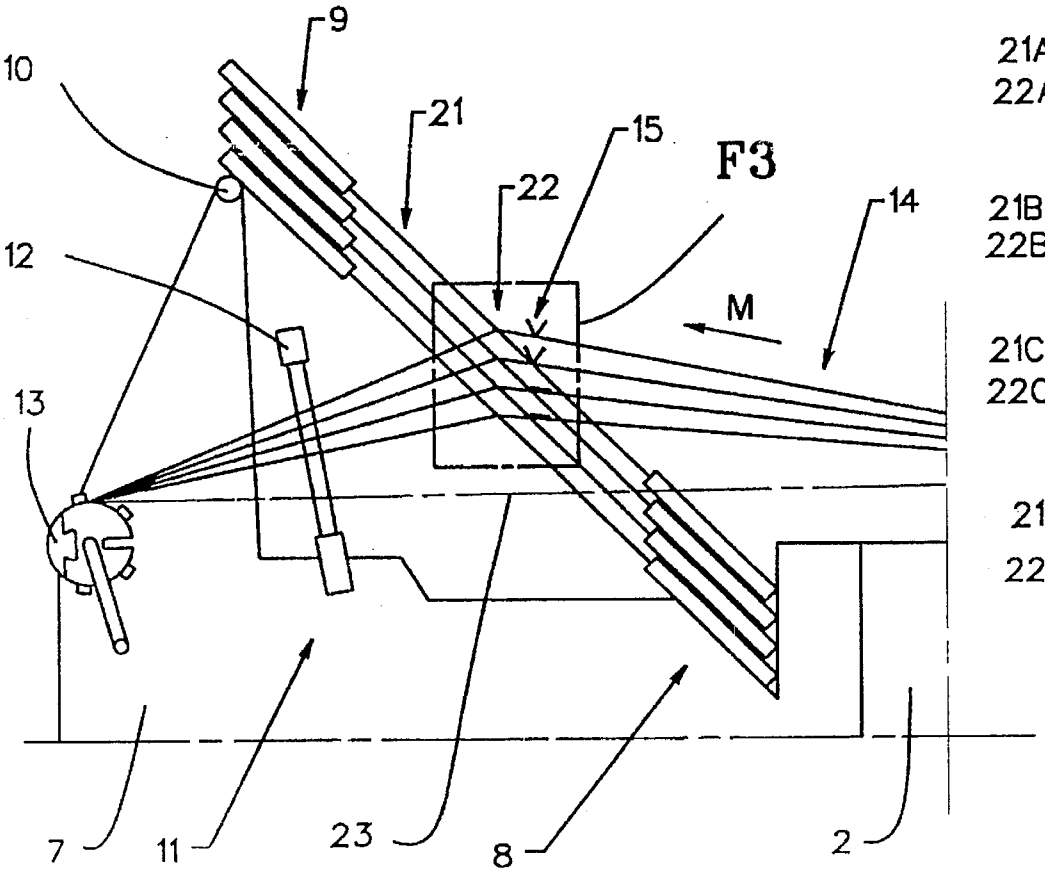
FIG. 2 is an enlarged cutaway of the section denoted by F2 in FIG. 1.

FIGS. 1 through 3 show that the knots or linkages 15 between the ends of the old warp threads and the beginnings of the new warp threads already have pulled through the warp stop motion 3 and are located near entering the apertures 22 of the harnesses 9. The apertures 22A through 22D of the heddles 21A through 21D are located in a common vertical plane while being mutually offset heightwise (i.e., the warp threads are all deflected simultaneously at the same location along their length by the apertures.). As a result of the warp threads 14A through 14D being fed to the particular harnesses 9 will be vertically separated. The warp threads 14A through 14D running toward the harnesses away from the warp stop motion 3 must pass through the heddles 21A through 21C and are combed in the process. The angle A between the warp 14A and the aperture 22A of the heddle 21A is the least because the aperture 22A is most remote from the connecting or plane line 23. Also, heddle 21A is the first heddle encountered by the warp threads as they are advanced in the direction M. This feature is advantageous because the knot 15A will not be combed. It was found that pulling the knots 15A through 15D through the apertures 22A through 22D demands a substantially lesser force. Furthermore it was found advantageous to array the apertures 22 of the heddles 21 of the individual harnesses at different heights.

Figure 4:
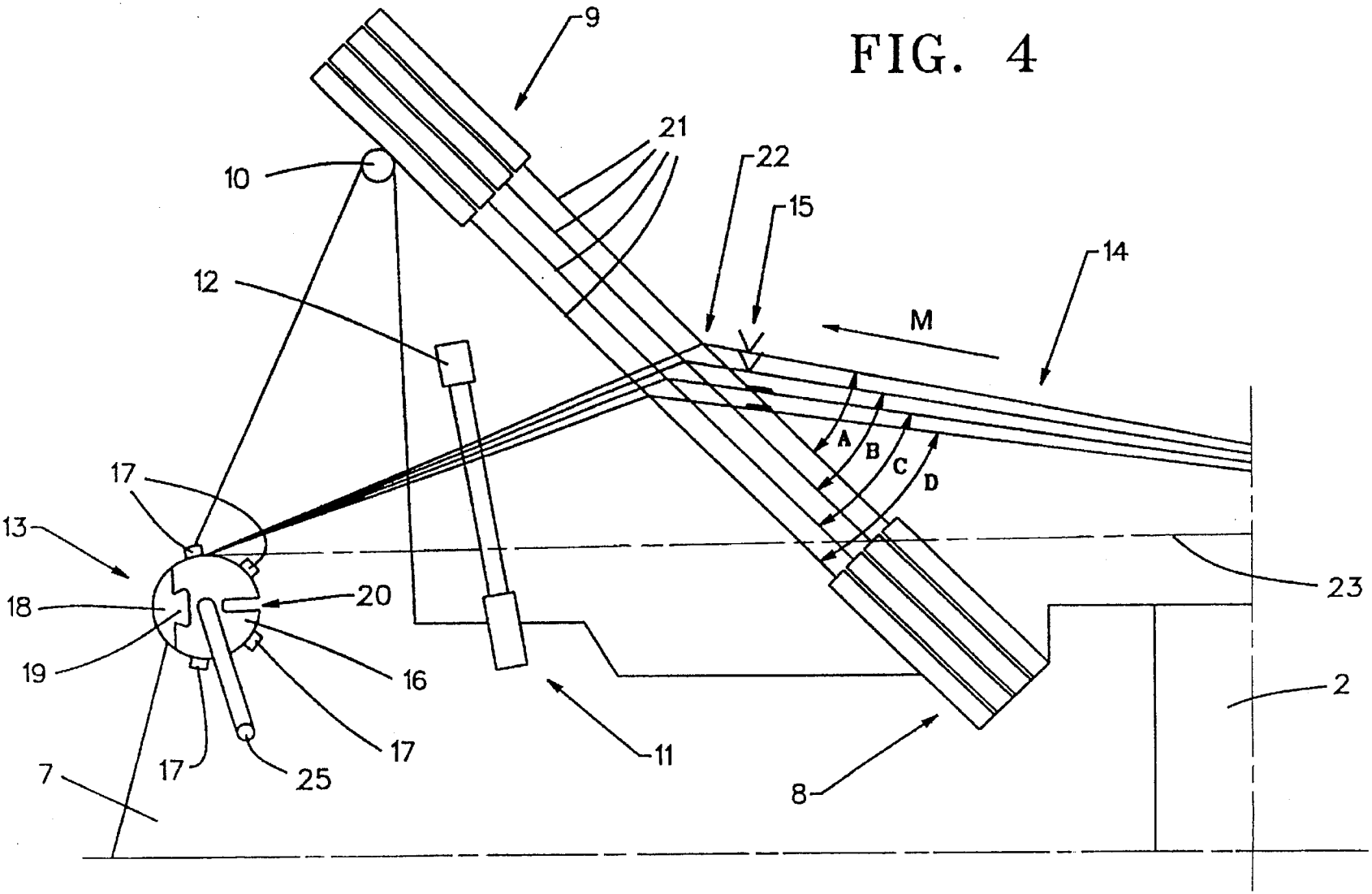
FIG. 4 is a variation of the embodiment of FIG. 2.

The embodiment of FIG. 4 is similar to that of FIG. 3, except that in this instance the harnesses 9 are not mutually shifted but run parallel. The harnesses 9 of this embodiment also subtend an angle of approximately 45° with the direction of warp advance M and consequently are mounted in such manner that the apertures 22 of the heddles 21 are not superposed in a vertical plane (with respect to line or plane 23) but instead are superposed in a plane slanting relative to the direction of advance M.

As shown in FIG. 3, the longitudinal sides of the apertures 22A through 22D slope relative to the direction of warp advance, that is, starting from the site where the warp threads 14A through 14D enter the particular apertures 22A through 22D. Obviously the harnesses 9 may also be mounted in such manner that they slope in mutually opposite directions. In the latter case however the apertures 22A through 22D should be offset to the other side relative to the connecting line 23 linking the previous system, i.e. the warp stop motion 3 or a whip roll 6 with the draw-in apparatus 13. In such a design the longitudinal sides of the apertures 22A through 22D, again seen from the entry site of the warp threads 14A through 14D, would be slanting relative to the direction of warp advance M.

Figure 5:
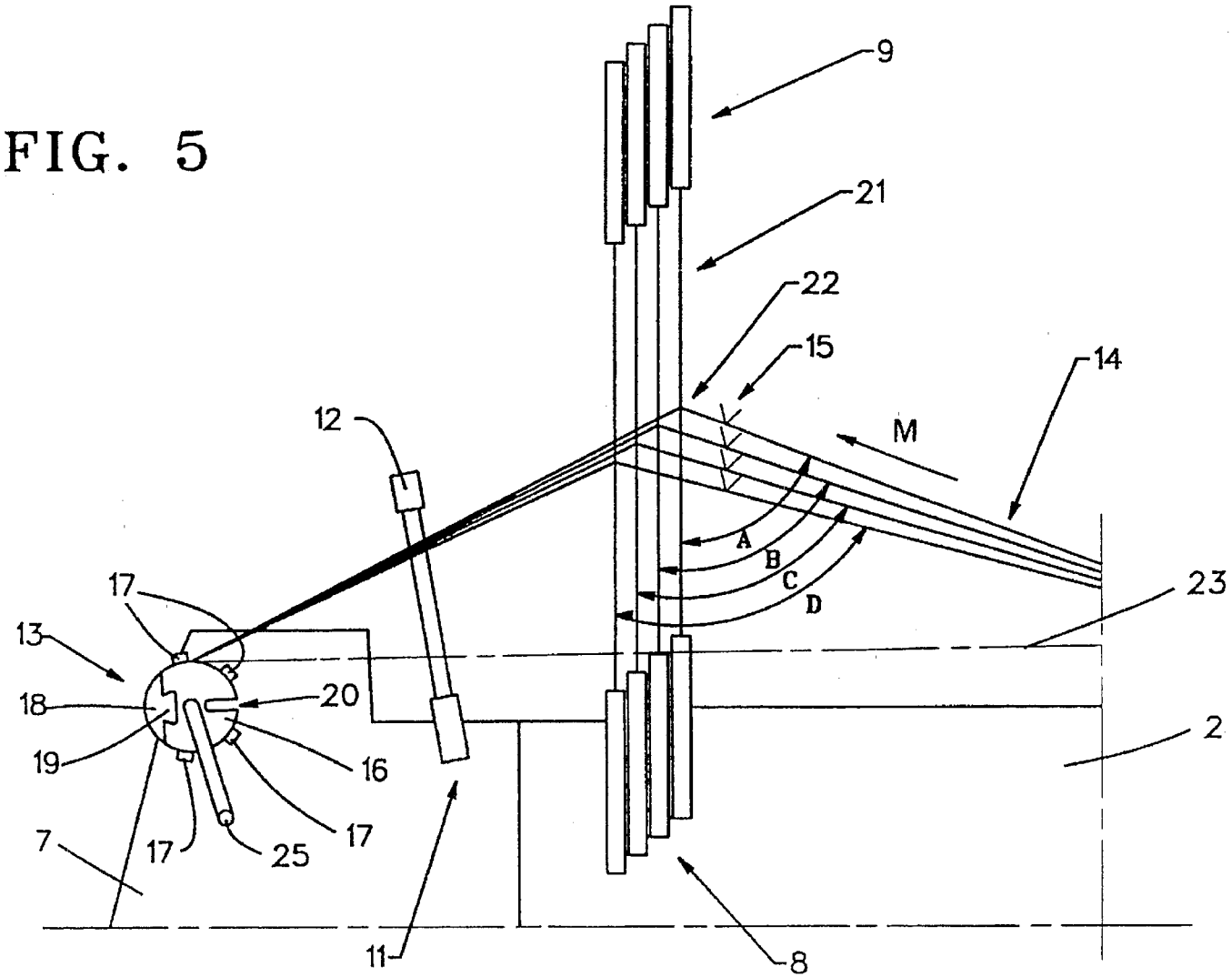
FIG. 5 is an embodiment comprising harnesses of a shed-forming device which are height-offset relative to the warp direction of advance.

The embodiment of FIG. 5 provides an acute angle of entry A through D of the warp threads 14 by so mounting the harnesses 9 that the apertures 22 of the heddles 21 are located outside the connecting line or plane 23 between the previous system (warp stop motion 3 or whip roll 6) and the draw-in apparatus 13. The housing 8 in this design is part of the loom portion 2 and of such configuration that the harnesses 9 as well as apertures 22 of the heddles 21 are held at different heights. This embodiment also provides that the angle A between the apertures 22 of the first harness 9 as seen in the direction of draw-in and the linked warp threads 14 shall be the least, said apertures 22 being most remote from the said connecting line or plane 23.

The draw-in apparatus 13 shown in FIGS. 4 and 5, which also is shown in FIGS. 1 and 2, comprises a shaft 16, bearing brushes 17 and a locking means 18. The locking means 18 comprises a projection or key 19 entering the shaft 16. The cylindrical shaft 16 is supported in rotatable manner and is equipped with a crank 25 for manual operation. The brushes 17 assure even tension in the warp threads 14 prior to draw-in. The locking means 18 clamps the warp threads 14 against the shaft 16. The linked warp threads 14 with the knots 15 are pulled in the direction M through the warp stop motion 3, the heddles 21 and the reed 12 until the knots 15 also shall have been wound on the draw-in apparatus 13. The warp threads are then severed. To facilitate such severing, the shaft 16 is fitted with a longitudinal channel 20 arranged to receive an appropriate severing tool.

Figure 6:
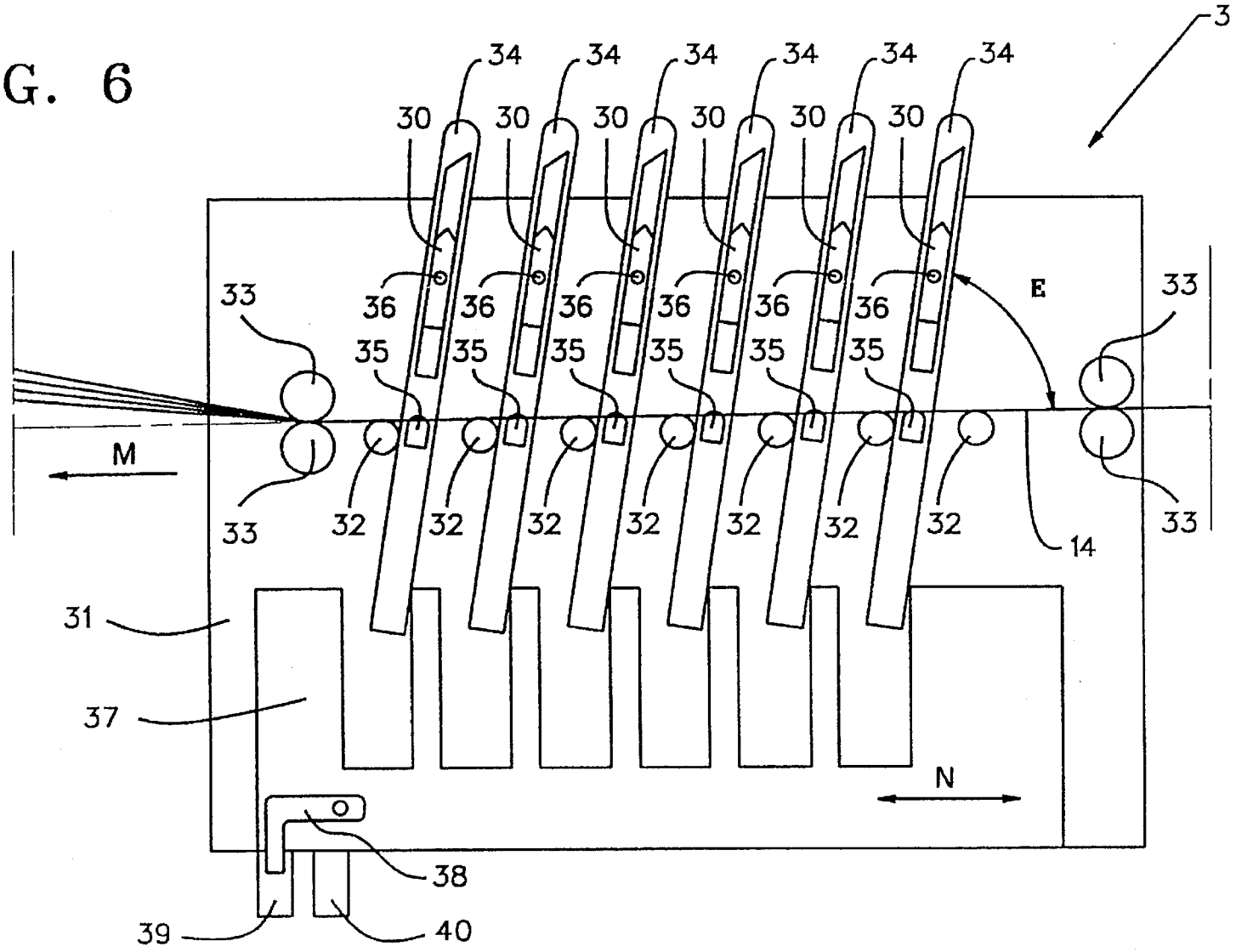
FIG. 6 is an enlarged cutaway of the section denoted by F6 in FIG. 1.

The warp stop motion 3 shown in FIGS. 1 and 6 comprises in a manner know per sea plurality of electrodes 30 having two electrical conductors separated by an insulating layer. These electrodes are mounted together with spindles 32 in a frame 31, said spindles 32 guiding the warp threads 14. Further conventional pairs of guide rollers 33 are present at the entry and outlet of the warp stop motion. Apertured elements in the form of warp stop motion drop-wires 34 are associated with the electrodes 30 and each includes an aperture 35 through which passes a particular warp thread 14. The warp stop motion drop-wires 34 rest by a sidewall of these apertures 30 on the warp threads 14. If a warp thread 14 were to rupture, the associated warp stop motion drop-wire 34 will drop and set up contact between the electrodes, thereby indicating warp rupture.

When drawing-in new warp threads 14, the ends of the old warp threads linked to them, in particular by a knot, also must be pulled through the apertures 35 of the warp stop motion drop-wires 34. To facilitate the process of pulling through, the invention provides that, starting from the normally vertical operational position, the warp stop motion drop-wires 34 may be moved into a position subtending an acute entry angle E. In the embodiment of FIG. 6, the electrodes 30 are supported on the frame illustratively made of an insulating material and are rotatable about pins 36. Using a comb-like system 37 which may be displaced parallel to the direction of warp advance M in the direction N, the warp stop motion drop-wires 34 together with the electrodes 30 may be pivoted about the pins 36 into the position shown in FIG. 6. The system 37 comprises a pawl 38 associated with recesses 39, 40. When the pawl 38 enters the recess 39, the insertion position shown will be assumed, whereas the normal operational position is assured by the pawl 38 entering the recess 40.

As shown by FIG. 6, the warp stop motion drop-wires 34 are pivoted until they almost touch the spindles 32. The warp stop motion drop-wires 34 then can rest against these spindles 32 when the warp threads 14 and their knots 15 are being drawn-in.

Figure 7:
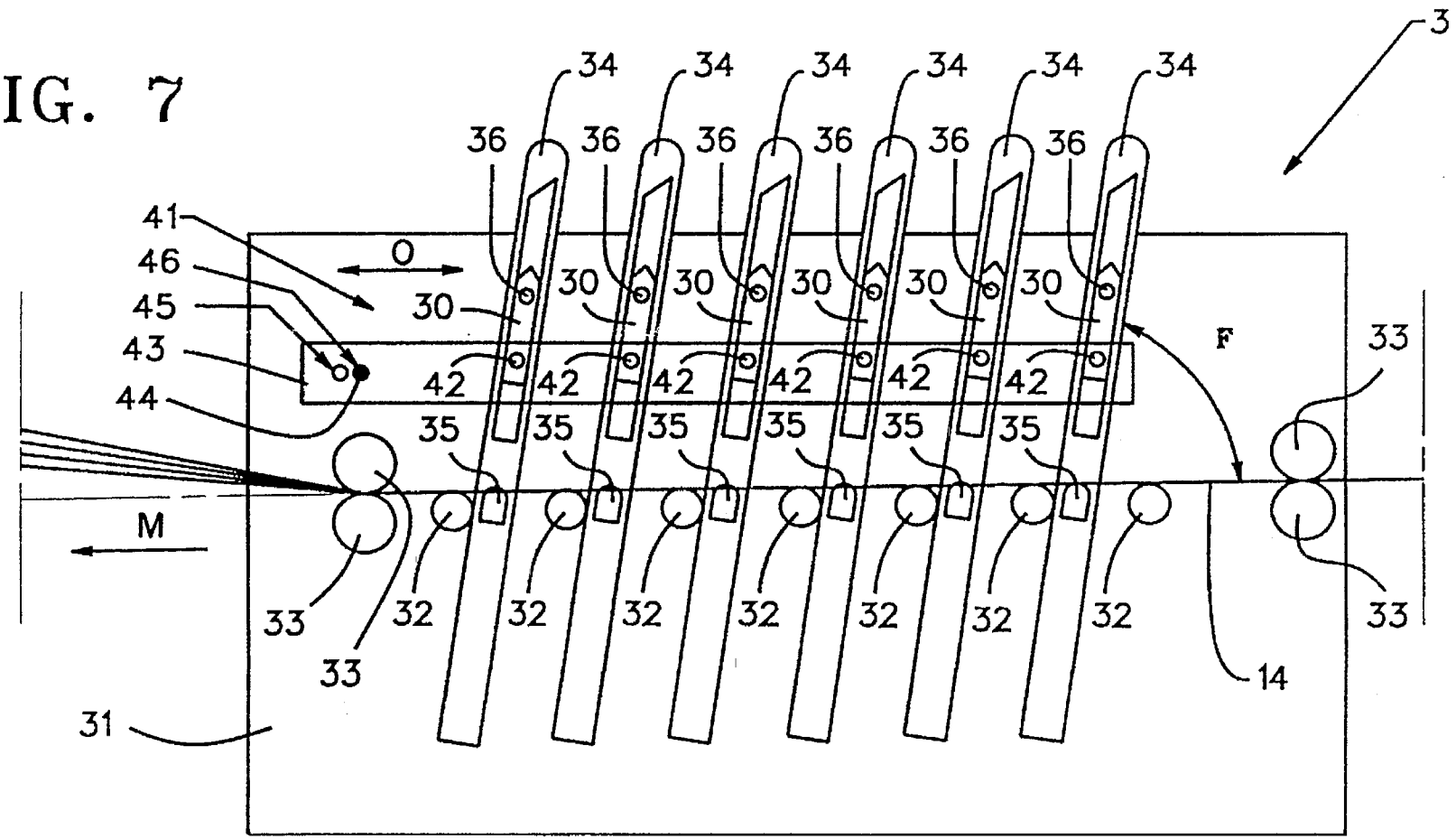
FIG. 7 is a variation of the embodiment of FIG. 6.

The embodiment of FIG. 7 comprises an adjustment mechanism 41 acting on the electrodes 30 to move the warp stop motion drop-wires 34 out of the vertical operational position into the shown drawn-in position. An acute entry angle F between the apertures 35 of the warp stop motion drop-wires 34 and the warp threads 14 is subtended in said drawn-in position. By means of pins 42 the electrodes 30 are linked to a common drive rod 43 reciprocating parallel to the warp direction of advance A in the direction O. The drawn-in and operational positions can be secured by a pawl-and-recess system composed of a bolt 44 projecting from the frame 31 and associated apertures 45, 46. In the shown drawn-in position, the bolt 44 engages the recess 46. In the operational position, wherein the warp stop motion drop-wires 34 are vertical, the bolt 44 engages the recess 45. The apertures 35 of the warp stop motion drop-wires 34 of the illustrative embodiments of FIGS. 6 and 7 assume an elongated shape running in the lengthwise direction of the warp stop motion drop-wires 34. The lesser transverse size is at least triple the warp cross-section, and the larger, longitudinal size is a multiple of the transverse one. The warp stop motion drop-wires 34 however may also be fitted with downward-open apertures, that is, they may be forked. The narrow sides of the apertures 35 resting on the warp threads 14 are rounded in semi-circular manner. These latter embodiments too provide that the warp stop motions 34 shall slant in such manner that starting with the sites where the warp threads 14 enter the apertures 35 (upper narrow side), the longitudinal sides of these apertures 35 shall slope relative to the direction of warp advance M.

I claim:

1. A method for advancing and drawing in new warp threads having thread connections through apertures of apertured elements of a weaving machine selected from the group including a warp stop motion and shed-forming device, comprising:

feeding and advancing the new warp threads towards and through the apertures in an advancing direction while maintaining the direction of advancement of the new warp threads towards the respective apertures at an angle less than 90° relative to the apertures.

2. A method as claimed in claim 1, wherein each of said apertures is defined at least in part by elongated opposed longitudinal sidewalls connected by relatively shorter opposed endwalls, including the step of maintaining the apertures and said longitudinal sidewalls inclined in a direction extending away from said direction of advancement.

3. A method as claimed in claim 2, including advancing the new warp threads beyond the apertures in a direction including a component extending in the same direction as said longitudinal sidewalls.

4. A method as claimed in claim 2, wherein said new warp threads are caused to engage one of said relatively shorter end walls of the respective apertures while being advanced through said apertures.

5. A method as claimed in claim 1, wherein said apertured elements are disposed in spaced relationship generally along the direction of advancement of the new warp threads so as to present a first aperture in a first apertured element that is first encountered by said warp threads before the warp threads encounter the remaining elements, including advancing the warp threads toward said apertures at varying angles, and such that the angle of advancement of the warp thread advanced through said first aperture relative to said first aperture is the least among the relative directions of advancement of the remaining warp threads relative to the remaining apertures.

6. A method of advancing and drawing in new warp threads linked by thread connections to old warp threads extending between the outer of a warp stop motion of a weaving machine and a draw-in device, said outlet and draw-in device lying in an imaginary first plane extending between and including said outlet and the region of the draw-in device engaged by the old warp threads, said old warp threads extending through apertures of apertured elements of the weaving machine selected from the group including a warp stop motion and a shed-forming device, comprising the steps of:

feeding and advancing the new warp threads and thread connections towards and through the apertures in an advancing direction while maintaining the direction of advancement of the new warp threads toward the respective apertures at an angle less than 90° relative to the apertures.

7. A method as claimed in claim 6, wherein said apertured elements are heddles of a shed-forming device, including maintaining the heddles in spaced relationship along the direction of advancement of the new warp threads while advancing the new warp threads and thread connections through the apertures.

8. A method as claimed in claim 7, including maintaining the apertures spaced heightwise from each other relative to said first plane while advancing the new warp threads and thread connections through the apertures.

9. A method as claimed in claim 7, including maintaining the heddles inclined relative to said first plane while advancing the new warp threads and thread connections through the apertures.

10. A method as claimed in claim 9, including maintaining the apertures both spaced from each other heightwise relative to said first plane and in an imaginary single second common plane extending perpendicular to said first plane while advancing the new warp threads and thread connections through the apertures.

11. A method as claimed in claim 9, including maintaining the apertures spaced apart along the direction of advancement of the new warp threads while advancing the new warp threads and thread connections through the apertures.

12. A method according to claim 11, including advancing the new warp threads and thread connections through the apertures of the heddles at different angles and at different distances from said first plane, the angle of advancement of the new warp thread most remote heightwise from the first plane relative to its respective aperture intersecting the aperture at the smallest angle among the angles of advancement of all the new warp threads relative to all the apertures, and arranging the heddles such that the most remote new warp thread is the last to encounter a heddle when all the new warp threads and thread connections are advanced through the apertures.

13. Apparatus for drawing in new warp threads of a new warp beam of a weaving machine wherein the new warp threads are connected by thread connections to old warp threads that extend to the drawing-in device and further wherein the weaving machine includes groups of apertured elements having apertures through which the new warp threads and thread connections are to be advanced, such apertured elements being selected from the group including stop motion devices and heddles of a shed-forming device, comprising:

a supporting arrangement for supporting at least one group of apertured elements relative to the direction of new warp thread advancement such that the new warp thread advancement direction towards the apertures on the warp thread approach side of the apertures is less than 90° relative to each aperture.

14. Apparatus according to claim 13, including a positioning device for varying the position of the apertured elements of the group relative to the advancing direction of the new warp threads such that the angle of advancement of the new warp threads relative to the apertures is variable.

15. Apparatus according to claim 13, wherein the supporting arrangement includes a support device that maintains the apertured elements in spaced relationship along the direction of advancement of the new warp threads.

16. Apparatus according to claim 15, wherein the apertures of the apertured elements are aligned and spaced apart heightwise from each other.

17. Apparatus according to claim 15, wherein the apertures of said apertured elements are spaced apart heightwise and along the direction of advancement of the new warp threads.

18. The apparatus according to claim 13, said apparatus including a drawing-in device engaging the old warp threads at an engagement region and a stop motion device including an outlet area; said outlet area and engagement region lying in a first imaginary plane extending therebetween; said one group of apertured elements are heddles of a shed-forming device; and said supporting arrangement is arranged to maintain the heddles generally perpendicular to said first plane.

19. Apparatus according to claim 18, wherein the apertures are spaced apart along the direction of the thread advancement.

20. Apparatus according to claim 19 wherein the apertures are spaced apart heightwise relative to said first plane.

21. Apparatus as claimed in claim 13, said apparatus including a drawing-in device engaging the old warp threads at an engagement region and a stop motion device including an outlet area; said outlet area and engagement region lying in a first imaginary plane extending therebetween; said one group of apertured elements are heddles of a shed-forming device; and said supporting arrangement is arranged to maintain the heddles inclined relative to said first plane.

22. Apparatus according to claim 21, wherein the apertures are spaced apart along the direction of warp thread advancement.

23. Apparatus according to claim 21, wherein the apertures of said apertured elements are spaced heightwise relative to said first plane.

24. Apparatus according to claim 22, wherein said apertures of said apertured elements are spaced heightwise relative to said first plane.

25. Apparatus according to claim 22, wherein the angles of approach to the apertures by the warp threads are different from each other, with the angle of approach of the warp thread extending through the most remote aperture from the first plane being less than the angles of approach of the remaining warp threads to their respective apertures.

26. Apparatus according to claim 24, wherein the angle of approach of the warp thread extending through the aperture closest to the common plane is greater than the angles of approach of the remaining warp threads relative their respective apertures.

* * * * *